US006792836B1

(12) United States Patent
Wang

(10) Patent No.: US 6,792,836 B1
(45) Date of Patent: Sep. 21, 2004

(54) SOCKET DRIVE HEAD STRUCTURE

(76) Inventor: Shyh Ming Wang, No. 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 10/350,261

(22) Filed: Jan. 20, 2003

(51) Int. Cl.[7] ..... B25B 23/00
(52) U.S. Cl. ..... 81/177.85; 403/324
(58) Field of Search ..... 81/177.85; 403/322.2, 403/322.3, 324, 361

(56) References Cited

U.S. PATENT DOCUMENTS 1,864,466 A * 6/1932 Peterson ..... 81/177.85
2,705,897 A * 4/1955 Nicholas ..... 81/177.85
3,006,668 A * 10/1961 Stewart ..... 403/324
3,039,340 A * 6/1962 Livermont ..... 81/177.85
4,645,368 A * 2/1987 Simpson et al. ..... 403/324
4,817,476 A * 4/1989 Karge ..... 81/177.85
4,865,485 A * 9/1989 Finnefrock, Sr. ..... 403/322.2
4,929,113 A * 5/1990 Sheu ..... 403/324
5,090,275 A * 2/1992 McCann ..... 81/177.85
5,291,809 A * 3/1994 Fox et al. ..... 81/177.85
6,199,457 B1 * 3/2001 Hoff et al. ..... 81/177.85
6,267,032 B1 * 7/2001 Hsieh ..... 81/177.85
2002/0189409 A1 * 12/2002 Lee ..... 81/177.85

* cited by examiner

*Primary Examiner*—Debra S. Meislin

(57) ABSTRACT

A socket drive head structure includes a drive head, an actuating rod, an actuating knob, a positioning ball, and an elastic member. Thus, the socket drive head structure is mounted on and detached from a socket rapidly, easily and conveniently, so that the user needs not to exert a large force to remove the socket from the socket drive head structure. Further, the outer threaded portion of the actuating knob is directly screwed into and locked in the threaded knob hole of the actuating rod, so that the actuating knob is actually fixed on the actuating rod easily and conveniently, thereby facilitating assembly and maintenance of the socket drive head structure.

5 Claims, 10 Drawing Sheets

SOCKET DRIVE HEAD STRUCTURE

BACKGROUND OF THE INVENTION

1. Field of the Invention

The present invention relates to a socket drive head structure, and more particularly to a socket drive head structure that is mounted on and detached from a socket easily and conveniently, so that the user needs not to exert a large force to remove the socket from the socket drive head structure.

2. Description of the Related Art

A conventional socket drive head in accordance with the prior art is inserted into a socket, and comprises a steel ball mounted between the socket drive head and the socket, so that the socket is locked on the socket drive head rigidly and closely. However, the user needs to exert a large force to remove the socket from the socket drive head, thereby causing inconvenience to the user in operation, and thereby wasting the manual work.

SUMMARY OF THE INVENTION

The present invention has arisen to mitigate and/or obviate the disadvantage of the conventional socket drive head.

The primary objective of the present invention is to provide a socket drive head structure that is mounted on and detached from a socket rapidly, thereby facilitating operation of the user.

Another objective of the present invention is to provide a socket drive head structure that is mounted on and detached from a socket easily and conveniently, so that the user needs not to exert a large force to remove the socket from the socket drive head structure.

A further objective of the present invention is to provide a socket drive head structure, wherein the outer threaded portion of the actuating knob is directly screwed into and locked in the threaded knob hole of the actuating rod, so that the actuating knob is actually fixed on the actuating rod easily and conveniently, thereby facilitating assembly and maintenance of the socket drive head structure.

In accordance with the present invention, there is provided a socket drive head structure, comprising a drive head, an actuating rod, an actuating knob, and a positioning ball, wherein:

the drive head has an inner wall formed with a receiving chamber, and has a first end formed with a positioning hole being vertical to and communicating with the receiving chamber and a second end formed with a guide slot being vertical to and communicating with the receiving chamber;

the actuating rod is movably mounted in the receiving chamber of the drive head, and has a first end formed with a ball cavity aligning with the positioning hole of the drive head and a second end formed with a knob hole aligning with the guide slot of the drive head;

the actuating knob is slidably mounted in the guide slot of the drive head and has a lower end secured in the knob hole of the actuating rod; and the positioning ball is positioned in the positioning hole of the drive head, and is partially received in the ball cavity of the actuating rod and partially protruded from the positioning hole of the drive head.

Further benefits and advantages of the present invention will become apparent after a careful reading of the detailed description with appropriate reference to the accompanying drawings.

DETAILED DESCRIPTION OF THE INVENTION

Figure 1:
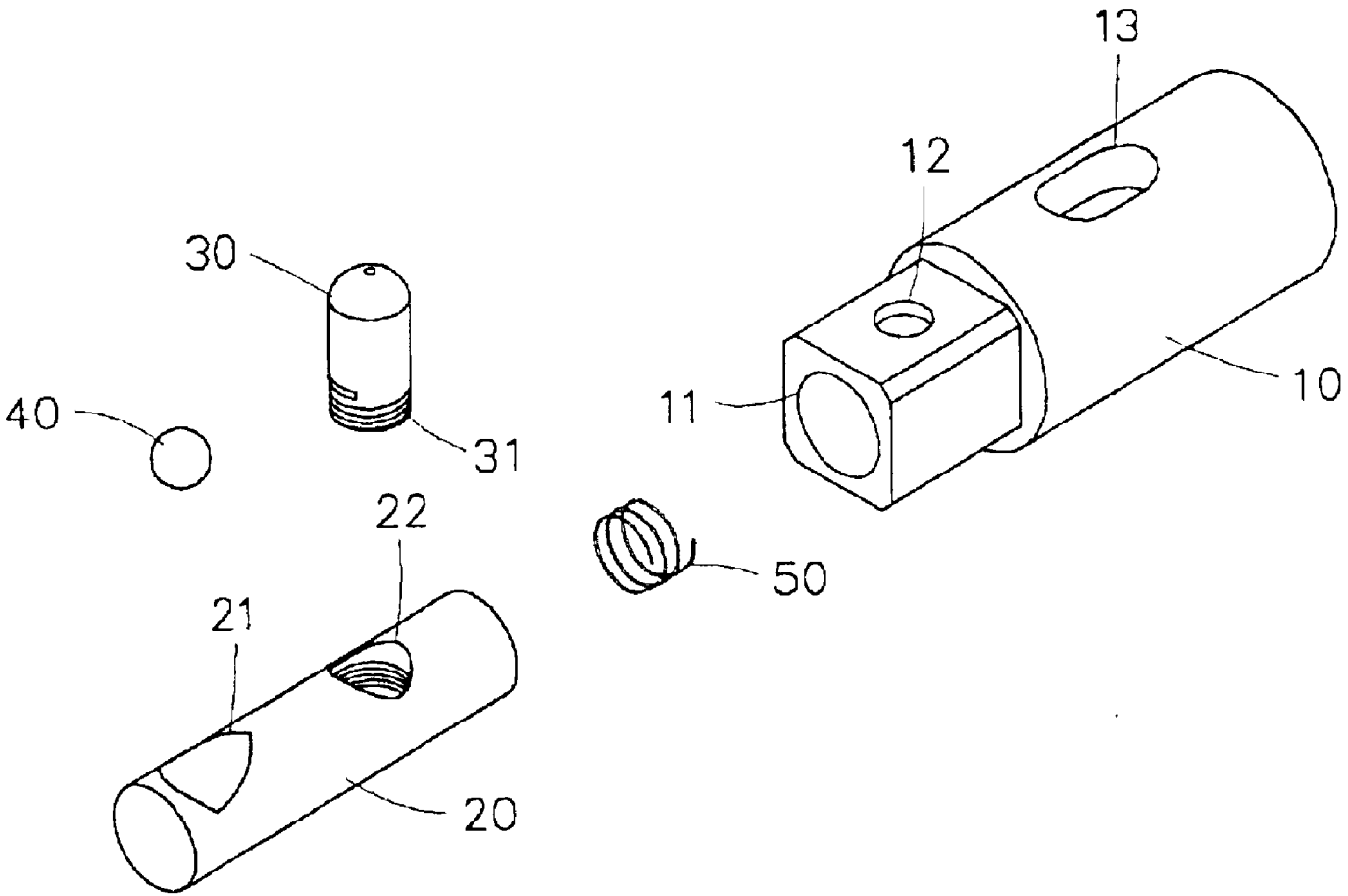
FIG. 1 is an exploded perspective view of a socket drive head structure in accordance with a first embodiment of the present invention.
Figure 2:
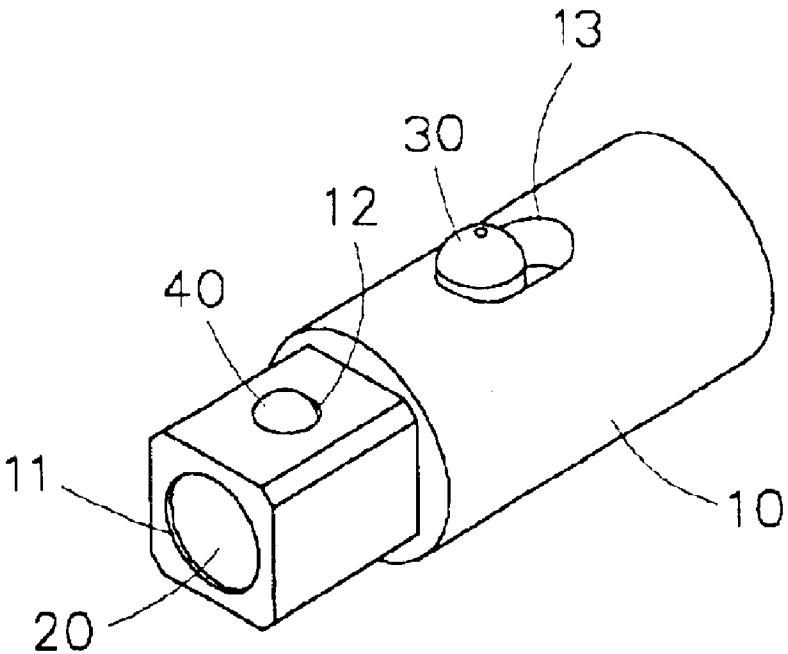
FIG. 2 is a perspective assembly view of the socket drive head structure as shown in FIG. 1.
Figure 3:
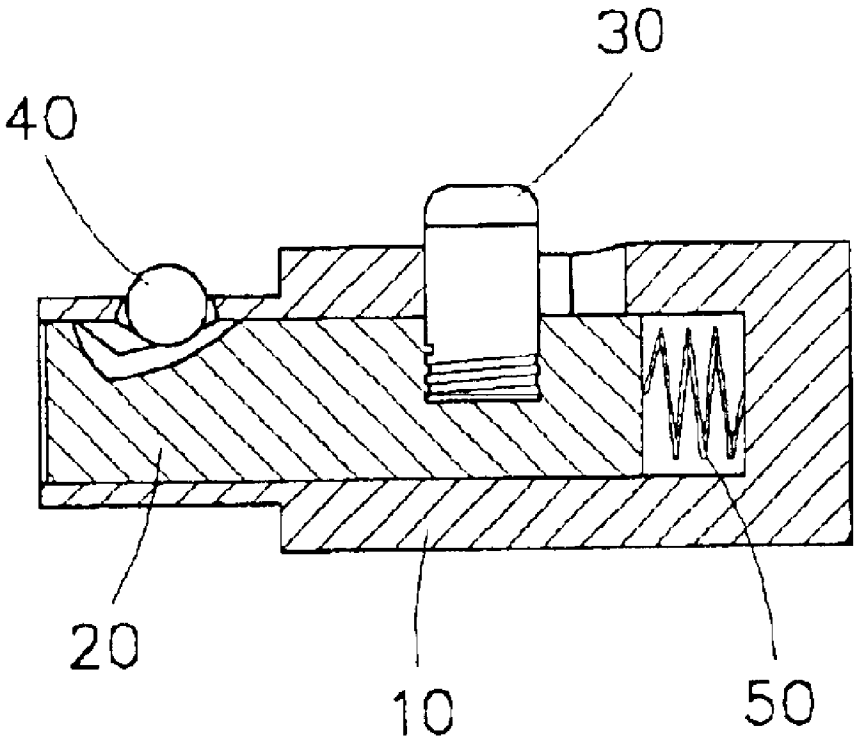
FIG. 3 is a side plan cross-sectional view of the socket drive head structure as shown in FIG. 2.

Referring to the drawings and initially to FIGS. 1–3, a socket drive head structure in accordance with a first embodiment of the present invention comprises a drive head 10, an actuating rod 20, an actuating knob 30, a positioning ball 40, and an elastic member 50.

The drive head 10 has an inner wall formed with a circular receiving chamber 11. The drive head 10 has a first end formed with a positioning hole 12 being vertical to and communicating with the receiving chamber 11 and a second end formed with a guide slot 13 being vertical to and communicating with the receiving chamber 11.

The actuating rod 20 is movably mounted in the receiving chamber 11 of the drive head 10. The actuating rod 20 has a first end formed with a ball cavity 21 aligning with the positioning hole 12 of the drive head 10 and a second end formed with a threaded knob hole 22 aligning with the guide slot 13 of the drive head 10.

The actuating knob 30 is slidably mounted in the guide slot 13 of the drive head 10 and has a lower end secured in the knob hole 22 of the actuating rod 20. Preferably, the lower end of the actuating knob 30 is formed with an outer threaded portion 31 screwed into the threaded knob hole 22 of the actuating rod 20, so that the actuating knob 30 is fixed on the actuating rod 20.

The positioning ball 40 is positioned in the positioning hole 12 of the drive head 10, and is partially received in the ball cavity 21 of the actuating rod 20 and partially protruded from the positioning hole 12 of the drive head 10.

The elastic member 50 is mounted in the receiving chamber 11 of the drive head 10, and is urged between the second end of the actuating rod 20 and the wall of the receiving chamber 11 of the drive head 10.

In assembly, the elastic member 50 is mounted in the receiving chamber 11 of the drive head 10. Then, the actuating rod 20 is mounted in the receiving chamber 11 of the drive head 10 and is urged on the elastic member 50. Then, the positioning ball 40 is pressed into the positioning hole 12 of the drive head 10 in any manner, so that the positioning ball 40 is positioned in the positioning hole 12 of the drive head 10 and is partially received in the ball cavity 21 of the actuating rod 20 and partially protruded from the positioning hole 12 of the drive head 10. Then, the wall of the positioning hole 12 of the drive head 10 is worked by a punching process or other treatment, thereby reducing the diameter of the wall of the positioning hole 12 of the drive head 10, so that the positioning ball 40 is locked in the positioning hole 12 of the drive head 10 without detachment. At this time, the actuating rod 20 is retained in the receiving chamber 11 of the drive head 10 by restriction of the positioning ball 40 without detachment. Finally, the actuating knob 30 is extended through the guide slot 13 of the drive head 10 and the outer threaded portion 31 of the actuating knob 30 is screwed into the threaded knob hole 22 of the actuating rod 20, so that the actuating knob 30 is fixed on the actuating rod 20. Thus, the actuating knob 30 is slidably mounted in the guide slot 13 of the drive head 10.

Figure 4:
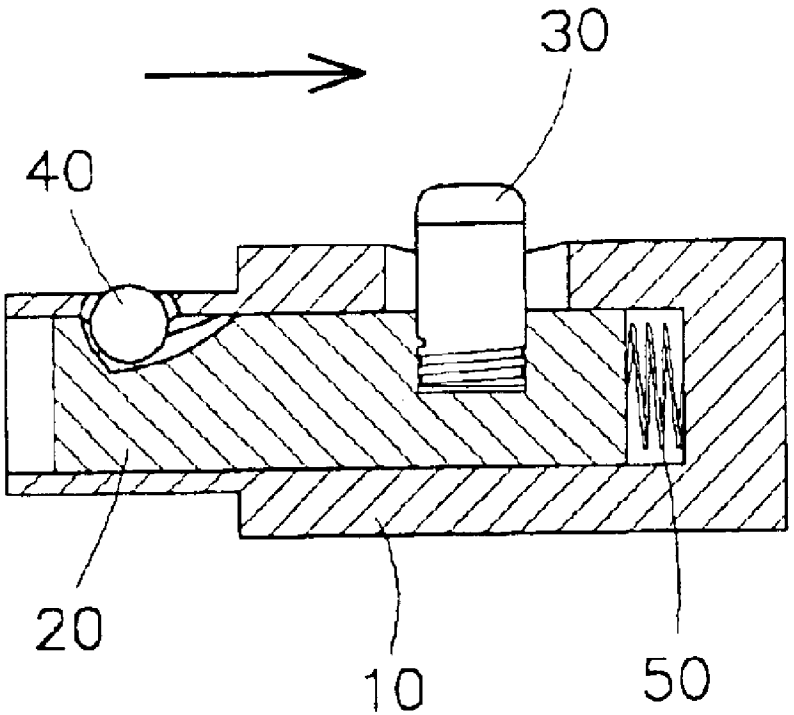
FIG. 4 is a schematic operational view of the socket drive head structure as shown in FIG. 3 in use.

In operation, referring to FIGS. 3 and 4 with reference to FIGS. 1 and 2, the user exerts a force on the actuating knob 30 to move the actuating knob 30 which drives the actuating rod 20 to move from the position as shown in FIG. 3 to the position as shown in FIG. 4, so that the positioning ball 40 is retracted into a deeper portion of the ball cavity 21 of the actuating rod 20 and is hidden in the positioning hole 12 of the drive head 10, thereby detaching the positioning ball 40 from a socket (not shown). After the force applied on the actuating knob 30 is removed, the actuating rod 20 is driven by the restoring force of the elastic member 50 to move from the position as shown in FIG. 4 to the position as shown in FIG. 3, so that the positioning ball 40 is moved into a shallower portion of the ball cavity 21 of the actuating rod 20 and is protruded outward from the positioning hole 12 of the drive head 10, thereby locking the positioning ball 40 in the socket.

Accordingly, the drive head 10 is mounted on and detached from the socket rapidly, thereby facilitating operation of the user. In addition, the drive head 10 is mounted on and detached from the socket easily and conveniently, so that the user needs not to exert a large force to remove the socket from the drive head 10 of the socket drive head structure. Further, the outer threaded portion 31 of the actuating knob 30 is directly screwed into the threaded knob hole 22 of the actuating rod 20, so that the actuating knob 30 is actually fixed on the actuating rod 20 easily and conveniently, thereby facilitating assembly and maintenance of the socket drive head structure of the present invention.

Figure 5:
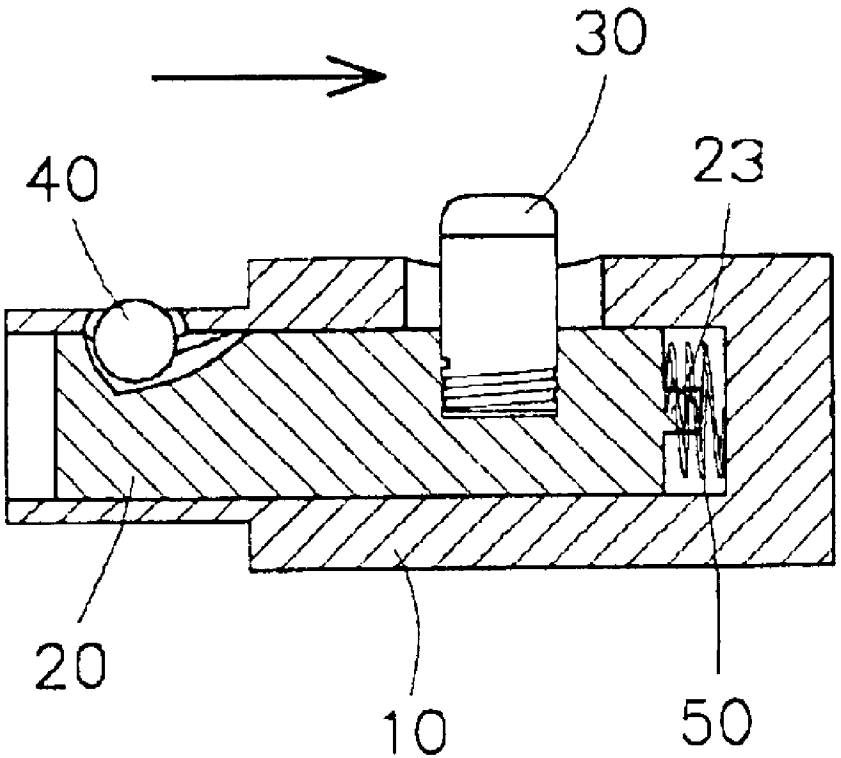
FIG. 5 is a side plan cross-sectional view of the socket drive head structure in accordance with a second embodiment of the present invention.

Referring to FIG. 5, the socket drive head structure in accordance with the second embodiment of the present invention is shown, wherein the second end of the actuating rod 20 is formed with a protruding stub 23 secured on the elastic member 50 for retaining the elastic member 50.

Figure 6:
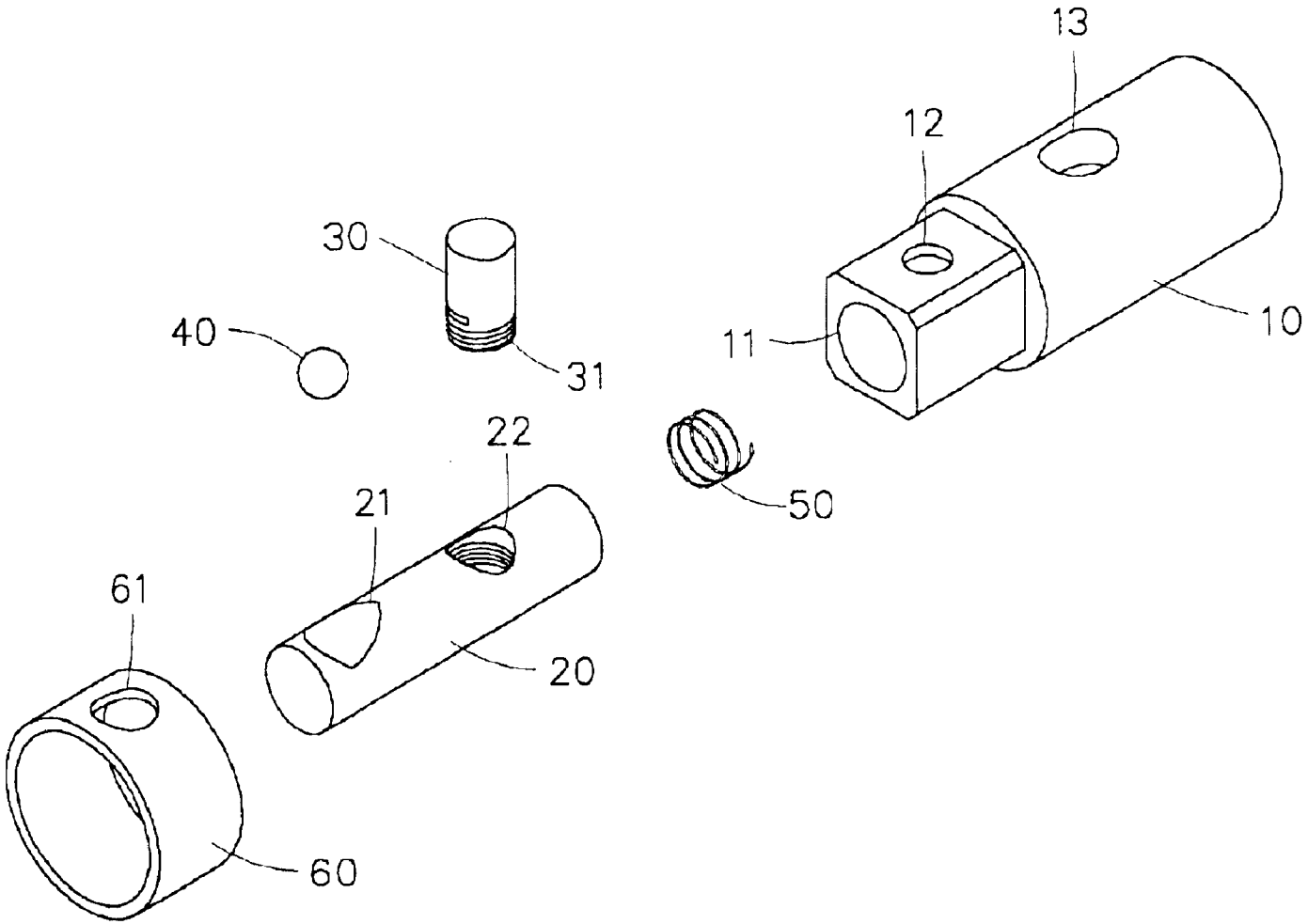
FIG. 6 is an exploded perspective view of a socket drive head structure in accordance with a third embodiment of the present invention.
Figure 7:
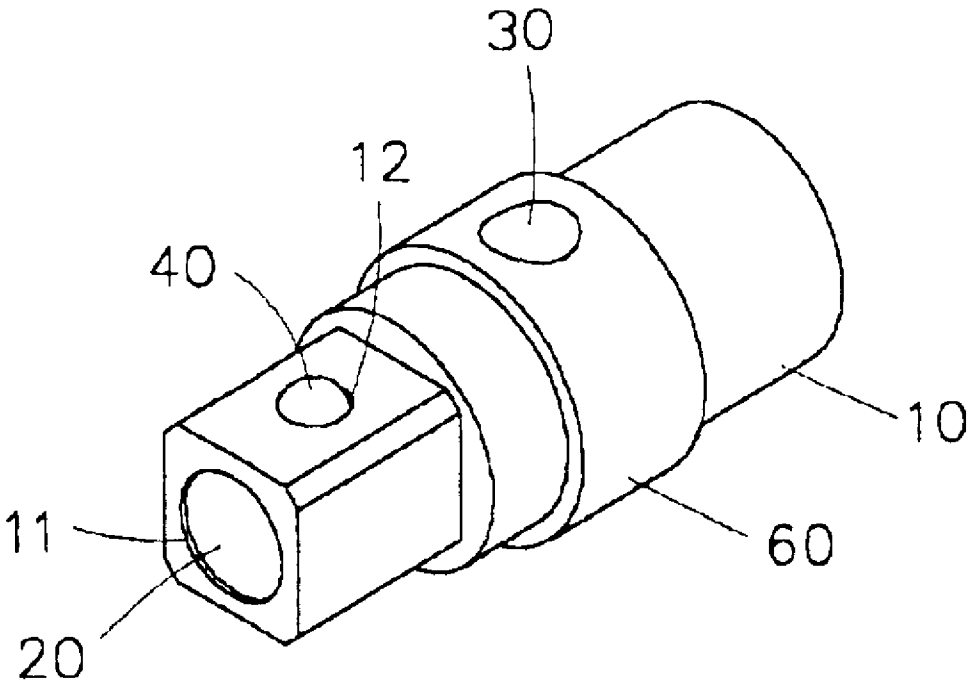
FIG. 7 is a perspective assembly view of the socket drive head structure as shown in FIG. 6.
Figure 8:
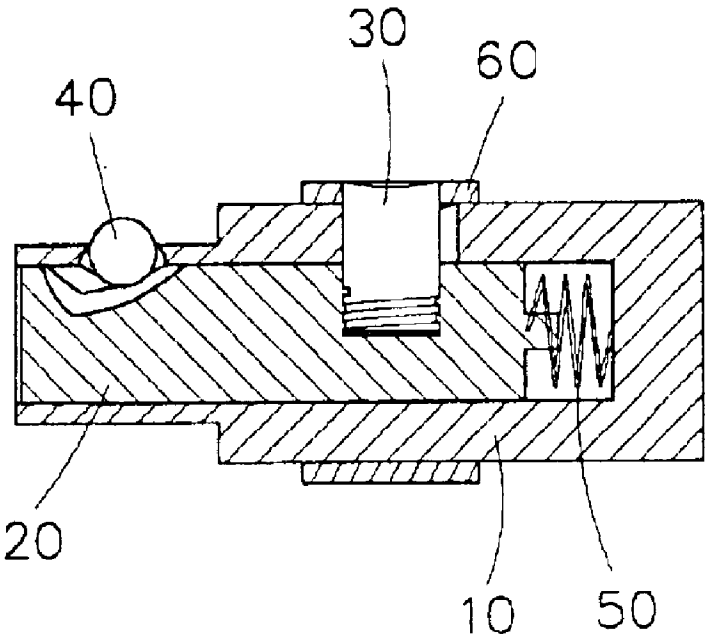
FIG. 8 is a side plan cross-sectional view of the socket drive head structure as shown in FIG. 7.

Referring to FIGS. 6–8, the socket drive head structure in accordance with the third embodiment of the present invention further comprises an actuating ring 60 slidably mounted on the drive head 10 and combined with the actuating knob 30 for moving the actuating knob 30. Preferably, the actuating ring 60 has a periphery formed with a through hole 61 for receiving and securing the actuating knob 30 therein.

Figure 9:
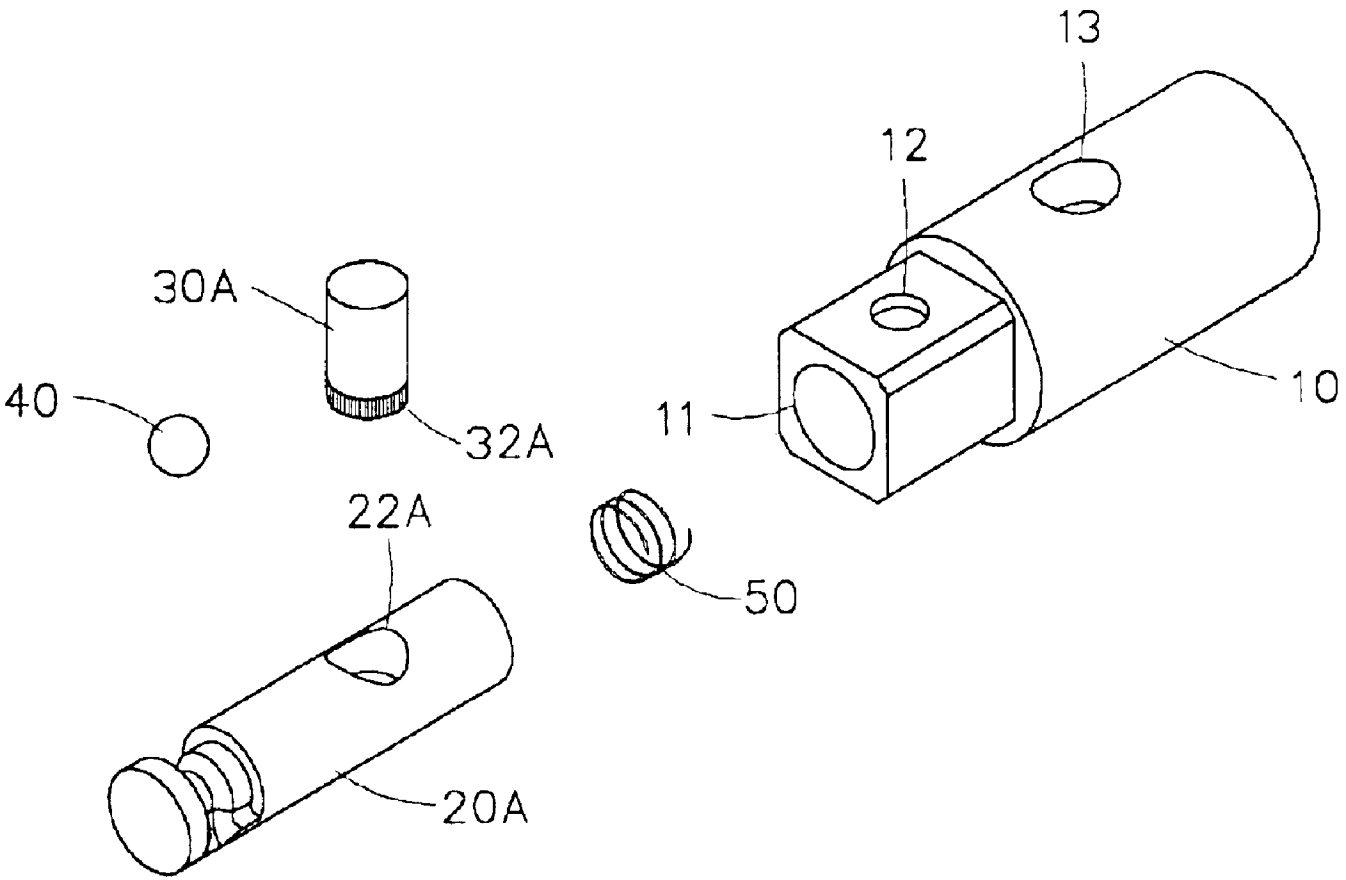
FIG. 9 is an exploded perspective view of a socket drive head structure in accordance with a fourth embodiment of the present invention.

Referring to FIG. 9, the socket drive head structure in accordance with the fourth embodiment of the present invention is shown, wherein the lower end of the actuating knob 30A is formed with a knurled face or serrated face 32A directly pressed into the knob hole 22A of the actuating rod 20A, so that the actuating knob 30A is fixed on the actuating rod 20A.

Figure 10:
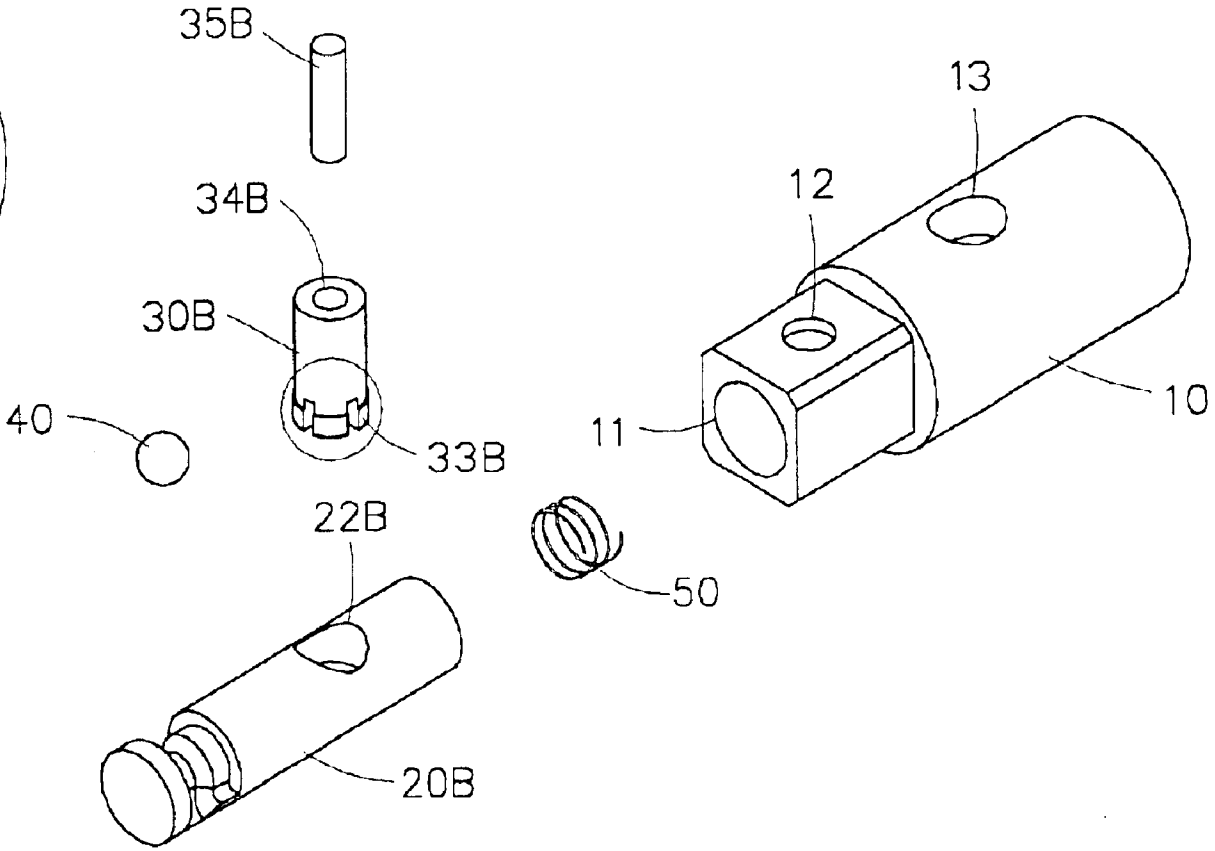
FIG. 10 is an exploded perspective view of a socket drive head structure in accordance with a fifth embodiment of the present invention.
Figure 11:
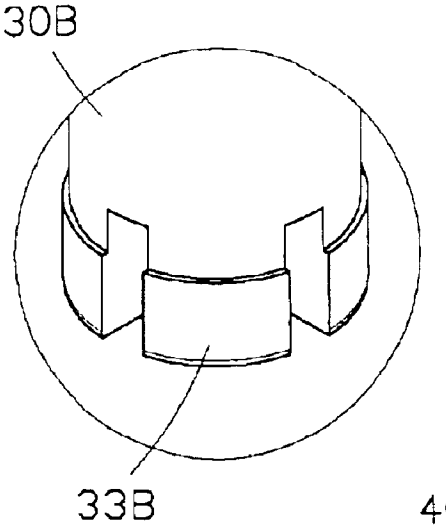
FIG. 11 is a partially enlarged view of the socket drive head structure as shown in FIG. 10.

Referring to FIGS. 10 and 11, the socket drive head structure in accordance with the fifth embodiment of the present invention is shown, wherein the lower end of the actuating knob 30B is formed with a tapered face 33B secured in the knob hole 22B of the actuating rod 20B, and the actuating knob 30B has an inner wall formed with a through hole 34B for passage of an urging pin 35B which is urged on the tapered face 33B for pressing the tapered face 33B in the knob hole 22B of the actuating rod 20B, so that the actuating knob 30B is fixed on the actuating rod 20B.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket drive head structure, comprising a drive head, an actuating rod, an actuating knob, and a positioning ball, wherein:

the drive head has an inner wall formed with a receiving chamber, and has a first end formed with a positioning hole being vertical to and communicating with the receiving chamber and a second end formed with a guide slot being vertical to and communicating with the receiving chamber;

the actuating rod is movably mounted in the receiving chamber of the drive head, and has a first end formed with a ball cavity aligning with the positioning hole of the drive head and a second end formed with a knob hole aligning with the guide slot of the drive head;

the actuating knob is slidably mounted in the guide slot of the drive head and has a lower end secured in the knob hole of the actuating rod;

the lower end of the actuating knob is formed with a tapered face secured in the knob hole of the actuating rod, and the actuating knob has an inner wall formed with a through hole for passage of an urging pin which is urged on the tapered face for pressing the tapered face of the actuating knob in the knob hole of the actuating rod, so that the actuating knob is fixed on the actuating rod; and the positioning ball is positioned in the positioning hole of the drive head, and is partially received in the ball cavity of the actuating rod and partially protruded from the positioning hole of the drive head.

2. The socket drive head structure in accordance with claim 1, further comprising an elastic member mounted in the receiving chamber of the drive head and urged between the second end of the actuating rod and the wall of the receiving chamber of the drive head.

3. The socket drive head structure in accordance with claim 2, wherein the second end of the actuating rod is formed with a protruding stub secured on the elastic member for retaining the elastic member.

4. The socket drive head structure in accordance with claim 1, further comprising an actuating ring slidably mounted on the drive head and combined with the actuating knob for moving the actuating knob.

5. The socket drive head structure in accordance with claim 4, wherein the actuating ring has a periphery formed with a through hole for receiving and securing the actuating knob therein.

* * * * *